US010550618B2

(12) United States Patent
Zhou et al.

(10) Patent No.: US 10,550,618 B2
(45) Date of Patent: Feb. 4, 2020

(54) FITTING ASSEMBLY AND WINDOW OR DOOR HAVING SUCH A FITTING ASSEMBLY

(71) Applicant: ROTO FRANK AG, Leinfelden-Echterdingen (DE)

(72) Inventors: Jinxuan Zhou, Stuttgart (DE); Kevin Bienert, Wendlingen (DE)

(73) Assignee: ROTO FRANK AG, Leinfelden-Echterdingen (DE)

( * ) Notice: Subject to any disclaimer, the term of this patent is extended or adjusted under 35 U.S.C. 154(b) by 141 days.

(21) Appl. No.: 15/969,329

(22) Filed: May 2, 2018

(65) Prior Publication Data

US 2018/0320429 A1 Nov. 8, 2018

(30) Foreign Application Priority Data

May 8, 2017 (DE) ..... 10 2017 207 707

(51) Int. Cl.
*E05D 15/30* (2006.01)
*E05D 11/00* (2006.01)

(52) U.S. Cl.
CPC ..... *E05D 15/30* (2013.01); *E05D 11/0018* (2013.01); *E05Y 2201/638* (2013.01); *E05Y 2600/634* (2013.01); *E05Y 2900/148* (2013.01)

(58) Field of Classification Search
CPC ..... E05D 15/42; E05D 15/44; E05D 15/28; E05D 11/0018; Y10T 16/547;
(Continued)

(56) References Cited

U.S. PATENT DOCUMENTS 4,833,754 A * 5/1989 Yang ..... E05D 15/30 16/337
5,083,344 A * 1/1992 Pettit ..... E05D 15/44 16/254

(Continued)

FOREIGN PATENT DOCUMENTS

DE 10 2014 226 590 A1 6/2016
GB 2 267 932 A 12/1993

(Continued)

OTHER PUBLICATIONS

European Office Action in EP 18167753.5 dated Sep. 17, 2018 with English translation of relevant parts.

*Primary Examiner* — Justin B Rephann
(74) *Attorney, Agent, or Firm* — Collard & Roe, P.C.

(57) ABSTRACT

A fitting assembly arranged between a fixed frame and a sash of a window or a door, comprises a fixed-frame-side support bracket, a sash-side support bracket, a scissor assembly as well as a spacer. The fixed-frame-side support bracket surrounds a fixed-frame corner of the fixed frame with a bearing leg and an additional support leg. The sash-side support bracket surrounds a sash corner of the sash with a bearing leg and an additional support-bracket leg. The spacer may either be arranged on the side of the additional support-bracket leg of the fixed-frame-side support bracket facing a first fixed-frame rebate face or on the side of the additional support-bracket leg of the sash-side support bracket facing a first sash rebate face. A scissor assembly supported on the bearing leg of the fixed-frame-side support bracket and on the bearing leg of the sash-side support bracket allows the sash to be rotationally and translationally moved with respect to the fixed frame.

15 Claims, 6 Drawing Sheets

(58) Field of Classification Search
CPC ..... Y10T 16/5453; Y10T 16/5476; Y10T 16/5478; E05Y 2900/148
See application file for complete search history.

(56) References Cited

U.S. PATENT DOCUMENTS 5,711,052 A * 1/1998 Delaske ..... E05D 15/30 16/245
5,898,977 A * 5/1999 Muir ..... E05D 15/44 16/341
7,047,600 B2 * 5/2006 Muir ..... E05D 15/30 16/346
2003/0213100 A1 * 11/2003 Brain ..... E05D 15/30 16/361
2005/0223524 A1 * 10/2005 Muir ..... E05D 15/30 16/366
2006/0150514 A1 * 7/2006 Miller ..... E05C 17/32 49/345
2010/0058667 A1 * 3/2010 Lambertini ..... E05D 7/0415 49/157
2015/0040351 A1 * 2/2015 Muir ..... E05D 11/06 16/343
2017/0167171 A1 * 6/2017 Fu ..... E05D 3/06
2017/0335612 A1 11/2017 Liu et al.
2018/0023329 A1 * 1/2018 Lambertini ..... E05D 7/0054 16/239

FOREIGN PATENT DOCUMENTS

GB 2 295 200 A 5/1996
GB 2 334 547 A 8/1999
GB 2 401 648 A 11/2004
WO 2016/127512 A1 8/2016

* cited by examiner

FITTING ASSEMBLY AND WINDOW OR DOOR HAVING SUCH A FITTING ASSEMBLY

CROSS REFERENCE TO RELATED APPLICATIONS

Applicant claims priority under 35 U.S.C. § 119 of German Application No. 10 2017 207 707.7 filed May 8, 2017, the disclosure of which is incorporated by reference.

BACKGROUND OF THE INVENTION

1. Field of the Invention

The present invention relates to a fitting assembly to be positioned between a fixed frame and a sash of a window or a door, the sash, in the mounted state of the fitting assembly, being movable by means of the fitting assembly relative to the fixed frame, by performing a rotational and a translational movement, comprising a fixed-frame-side support bracket, to be positioned on a fixed-frame corner, which is formed by fixed-frame rebate faces of the fixed frame, the fixed-frame-side support bracket having two support-bracket legs, of which a first support-bracket leg is configured to be fixed to a first fixed-frame rebate face of the fixed-frame rebate faces and is provided as a bearing leg of the fixed-frame-side support bracket and of which a second support-bracket leg is configured to be fixed to a second fixed-frame rebate face of the fixed-frame rebate faces and is provided as an additional support-bracket leg of the fixed-frame-side support bracket, and a guiding contour for a sash-side sash guiding element being provided on the fixed-frame-side support bracket, comprising a sash-side support element, which is configured to be fixed on a first sash rebate face of the sash, which together with a second sash rebate face of the sash forms a sash corner and which, in a closed state of the fitting assembly, is opposite the bearing leg of the fixed-frame-side support bracket, the closed state of the fitting assembly, in the mounted state of the fitting assembly, being present when the sash is closed with respect to the fixed frame, and the sash corner formed by the first and the second sash rebate faces on one hand and the fixed-frame corner formed by the first and the second fixed-frame rebate faces on the other hand being opposite each other, comprising a scissor assembly, which on one hand is supported on the bearing leg of the fixed-frame-side support bracket and on the other hand on the sash-side support element and by means of which the sash-side support element is movable relative to the bearing leg of the fixed-frame-side support bracket by performing a rotational and a translational movement, and comprising a spacer, which is configured to be positioned on the side of the additional support-bracket leg of the fixed-frame-side support bracket, which side, in the mounted state of the fitting assembly, faces the second fixed-frame rebate face.

The invention also relates to a window or a door, comprising a fixed frame and comprising a sash, which is movable with respect to the fixed frame by means of a fitting assembly positioned between the fixed frame and the sash by performing a rotational and a translational movement, a fixed-frame corner being formed by a first fixed-frame rebate face and a second fixed-frame rebate face of the fixed frame and a sash corner being formed by a first sash rebate face and a second sash rebate face of the sash and, when the sash is closed with respect to the fixed frame, the sash corner formed by the first and the second sash rebate faces on one hand and the fixed-frame corner formed by the first and the second fixed-frame rebate faces on the other hand, being opposite each other.

By means of fitting assemblies of the above-mentioned type, sashes, such as of a window, are guided during opening and closing movements with respect to an associated fixed frame, such that the sash rotates relative to the fixed frame about a rotational axis, which is parallel to a main plane of the window, door or similar, and also performs a translational movement perpendicular to the main plane with respect to the fixed frame, without the sash, in particular an overlap of the sash, colliding with the fixed frame. In the closed state, the sash is at least substantially located within the fixed frame. The sash rebate faces extend in the peripheral direction of the sash and the fixed-frame rebate faces extend in the peripheral direction of the fixed frame, both the sash rebate faces and the fixed-frame rebate faces extending perpendicularly with respect to the main plane of the window or door while being opposite each other thus forming a rebate gap, or "rebate clearance". The fitting assembly allows the load from the sash to be transferred to the fixed frame. In order to precisely guide the sash, in particular in the end phase of the closing movement, a fixed-frame-side guiding contour and a sash guiding element interacting therewith are used, the sash guiding element being positioned on the side of the rotational axis of the sash.

2. Description of the Related Art

Generic state of the art is known from GB 2 267 932 A. This publication discloses a fitting assembly in the form of a friction scissor provided for a window. The previously known friction scissor comprises a fixed-frame-side support bracket to be screwed to a fixed window frame in the region of a corner thereof. The fixed-frame-side ends of scissor elements of the friction scissor are supported on a first support-bracket leg of said support bracket so as to be able to rotate and to be shifted along the support-bracket leg. A second support-bracket leg provided with a guiding surface, which in turn interacts with a countersurface on one end of a rod-like support element which is screwed to the sash of the previously known window, extends perpendicularly to the first support-bracket leg of the fixed-frame-side support bracket. The sash-side ends of a part of the scissor elements of the friction scissor, which scissor elements are rotatably and translationally supported on the fixed-frame-side support bracket, are rotatably linked to the rod-like sash-side support element.

SUMMARY OF THE INVENTION

It is an object of the present invention to increase the stability of the mounting of a rotationally and translationally movable sash of a window or a door, on an associated fixed frame with respect to above-cited state of the art, in particular also in the case of varying installation conditions.

According to the invention, this object is achieved by the fitting assembly comprising a fixed-frame-side support bracket, to be positioned on a fixed-frame corner, which is formed by fixed-frame rebate faces of the fixed frame, the fixed-frame-side support bracket having two support-bracket legs, of which a first support-bracket leg is configured to be fixed to a first fixed-frame rebate face of the fixed-frame rebate faces and is provided as a bearing leg of the fixed-frame-side support bracket and of which a second support-bracket leg is configured to be fixed to a second fixed-frame rebate face of the fixed-frame rebate faces and is provided as an additional support-bracket leg of the fixed-frame-side support bracket, and a guiding contour for a sash-side sash guiding element being provided on the fixed-frame-side support bracket. The assembly comprises a sash-side support element, which is configured to be fixed on a first sash rebate face of the sash, which together with a second sash rebate face of the sash forms a sash corner and which sash-side support element, in a closed state of the fitting assembly, is opposite the bearing leg of the fixed-frame-side support bracket, the closed state of the fitting assembly, in the mounted state of the fitting assembly, being present when the sash is closed with respect to the fixed frame, and the sash corner formed by the first and the second sash rebate faces on one hand and the fixed-frame corner formed by the first and the second fixed-frame rebate faces on the other hand being opposite each other.

The scissor elements of a scissor assembly, which are provided between the fixed frame and the sash and which are rotatably and/or translationally mounted on the fixed-frame-side as well as on the sash side, are linked both to the fixed frame and to the sash by means of a support bracket. The fixed-frame-side support bracket surrounds the corner concerned of the fixed frame and may be connected to the fixed frame at both fixed-frame rebate faces forming the corner of the fixed frame, in particular by screwing. Correspondingly, it is possible to connect or screw the sash-side support bracket to the sash on both sash rebate surfaces of the sash corner, which is surrounded by the sash-side support bracket. Due to their attachment to both rebate surfaces of the fixed-frame corner and the sash corner respectively, the two support brackets create a load-bearing connection between the sash and the fixed frame.

The sash-side sash guiding element is provided on the sash-side support bracket. There the sash-side sash guiding element protrudes with respect to the additional support-bracket leg of the sash-side support bracket on the side of the additional support-bracket leg which faces away from the second sash rebate face in the installed state of the fitting assembly, wherein the additional support-bracket leg extends along the second sash rebate face. The guiding contour provided on the fixed-frame-side support bracket for the sash-side sash guiding element has, on the side of the additional support-bracket leg of the fixed-frame-side support bracket facing the second fixed-frame rebate face in the installed state of the fitting assembly, a projection relative to the additional support-bracket leg of the fixed-frame-side support bracket.

The distance between the additional support-bracket leg of the fixed-frame-side support bracket and the additional support-bracket leg of the sash-side support bracket, when the sash is closed, is predetermined by design and unchangeable. This distance determines the width of the rebate clearance, i.e. the width of the gap between the second fixed-frame rebate face and the second sash rebate face. By means of the spacer of the fitting assembly according to the invention, a value for the rebate clearance, the value being required regardless of the installation conditions, may be obtained using one and the same fitting assembly in varying installation conditions.

If the second fixed-frame rebate face of the fixed frame is a groove-free planar rebate face, then the additional support-bracket leg of the fixed-frame-side support bracket is held, by the projection of the guiding contour provided on the fixed-frame-side support bracket for the sash-side sash guiding element, at a distance from the second fixed-frame rebate face. The interspace thus obtained between the additional support-bracket leg of the fixed-frame-side support bracket on one hand and the second fixed-frame rebate face on the other hand can be bridged by the spacer of the fitting assembly according to the invention. The spacer thus allows planar support of the additional support-bracket leg of the fixed-frame-side support bracket on the second fixed-frame rebate face and thus a load-absorbing connection between the additional support-bracket leg of the fixed-frame-side support bracket and the fixed frame. The additional support-bracket leg of the sash-side support bracket may be directly planarly applied, on the sash side, to the second sash rebate face, and in particular screwed to the sash so as to create a load-bearing connection.

If the fixed frame is provided on the second fixed-frame rebate face with a fitting groove, then the projection of the guiding contour provided on the fixed-frame-side support bracket for the sash-side sash guiding element can be inserted into the fitting groove. The additional support-bracket leg of the fixed-frame-side support bracket thus approaches the associated second fixed-frame rebate face. Jointly with the additional support-bracket leg of the fixed-frame-side support bracket, the additional support-bracket leg of the sash-side support bracket connected to the fixed-frame-side support bracket via the scissor assembly also gets closer to the second fixed-frame rebate face. In order to avoid that the rebate clearance on the second fixed-frame rebate face and the second sash rebate face, which rebate clearance is provided between the sash provided with the sash-side support bracket and the fixed frame provided with the fixed-frame-side support bracket, is reduced to a value that is too small, the spacer is positioned between the additional support-bracket leg of the sash-side support bracket and the second sash rebate face that is arranged opposite said support-bracket leg. In this way, the spacer creates the required distance, i.e. the required rebate clearance, between the second fixed-frame rebate face and the second sash rebate face. On the side of the fixed frame, the additional support-bracket leg of the fixed-frame-side support bracket rests on the second fixed-frame rebate face. On the sash side, for the additional support-bracket leg of the sash-side support bracket, a planar contact on the second sash rebate face is obtained by means of the spacer. On the fixed-frame-side, therefore, a load-bearing connection between the additional support-bracket leg of the fixed-frame-side support bracket and the fixed frame can be provided, while on the sash side, a loadable connection between the additional support-bracket leg of the sash-side support bracket and the sash can be provided. The value of the rebate clearance in this installation situation between the second fixed-frame rebate face and the second sash rebate face corresponds to the rebate clearance which is obtained when mounting the fitting on a groove-free second fixed-frame rebate face, as previously described.

If the second fixed-frame rebate face is a planar groove-free rebate face and the spacer is thus positioned between the additional support-bracket leg of the fixed-frame-side support bracket and the second fixed-frame rebate face, then the fitting assembly according to the invention allows for an effective transmission of forces between the sash and the fixed frame, regardless of whether the second sash rebate face, to which the additional support-bracket leg of the sash-side support bracket is attached, is a groove-free planar rebate face or also has a fitting groove. In the latter case, according to the invention, the additional support-bracket leg of the sash-side support bracket has a width, in the direction perpendicular to the main plane of the sash, which is larger than the opening width of the fitting groove on the second sash rebate face. Due to the excess of width of the additional support-bracket leg of the sash-side support bracket relative to the opening width of the fitting grove on the second sash rebate face, the additional support-bracket leg of the sash-side support bracket is able to rest on and externally cover the fitting groove on the second sash rebate face and can, in particular, be connected to the sash on the groove base of the sash-side fitting groove, in particular by screwing.

If the second fixed-frame rebate face has a fitting groove, then according to the invention, the spacer may be positioned on the sash side both when the second sash rebate face is a groove-free planar rebate face and when the second sash rebate face is provided with a fitting groove extending along the peripheral direction of the sash. In the first case, the spacer may be mounted so as to rest, regardless of the width thereof, on the second sash rebate face and thus easily ensure effective force transmission between the sash and the fixed frame. In the second case, the width of the spacer according to the invention is larger than the opening width of the fitting groove on the second sash rebate face. Thus, the spacer may cover the fitting groove on the second sash rebate face and rest, so as to ensure effective force transmission between the sash and the fixed frame, on both sides of the groove opening of the fitting groove on the second sash rebate face.

In a development of the fitting assembly according to the invention, the spacer is removably connected to the additional support-bracket leg of the fixed-frame-side support bracket or to the additional support-bracket leg of the sash-side support bracket and, thus, either forms a unit with the fixed-frame-side support bracket or with the sash-side support bracket. Due to this connection, the spacer and the fixed-frame-side support bracket or the spacer and the sash-side support bracket may be handled as one unit in particular during transport to the mounting site and/or when mounting the fitting.

In another embodiment, a defined arrangement of the spacer on the additional support-bracket leg of the fixed-frame-side support bracket and/or on the additional support-bracket leg of the sash-side support bracket is ensured. To this end, a positioning element is provided on the additional support-bracket leg of the fixed-frame-side support bracket and/or on the additional support-bracket leg of the sash-side support bracket and/or on the spacer. A defined arrangement of the spacer on the fixed-frame-side support bracket or on the sash-side support bracket in particular simplifies the mounting of the fitting.

In a preferred embodiment of the invention, for the sake of simplicity, it is possible to create the connection between the additional support-bracket leg of the fixed-frame-side support bracket and the fixed frame and/or the connection between the additional support-bracket leg of the sash-side support bracket and the sash through the spacer. To this end, the spacer according to the invention has a passage opening for a fastening element, which, depending on the arrangement of the spacer, is aligned with a passage opening, provided for a fastening element, on the additional support-bracket leg of the fixed-frame-side support bracket or with a corresponding passage opening on the additional support-bracket leg of the sash-side support bracket.

In a development of the invention, measures are implemented for a mutual fine adjustment of the sash and of the fixed frame, in particular for a fine adjustment of the rebate clearance between the sash and the fixed frame. To this end, the additional support-bracket leg of the fixed-frame-side support bracket and/or the additional support-bracket leg of the sash-side support bracket is/are provided with an opening for an adjustment element, by means of which the position of the fixed-frame-side support bracket relative to the fixed frame may be adjusted perpendicularly to the additional support-bracket leg of the fixed-frame-side support bracket or by means of which the position of the sash-side support bracket relative to the sash may be adjusted perpendicularly to the additional support-bracket leg of the sash-side support bracket. The adjustment element may be guided on the spacer, but also or alternatively on the additional support-bracket leg of the fixed-frame-side support bracket and/or on the additional support-bracket leg of the sash-side support bracket. If the adjustment element is guided on the spacer, then the opening on the additional support-bracket leg of the fixed-frame-side support bracket or the opening on the additional support-bracket leg of the sash-side support bracket may be provided in order to enable the adjustment element on the spacer to be accessed by an actuation tool. In particular, the adjustment element may be an adjustment screw, which engages, by means of the external thread thereof, in the internal thread of a passage opening, which is penetrated by the adjustment screw.

In another embodiment, a component that is separate from the bearing leg of the fixed-frame-side support bracket is provided as the guiding contour for the sash-side sash guiding element.

If the connection between the guiding contour for the sash-side sash guiding element and the bearing leg of the fixed-frame-side support bracket is releasable, then the fitting arrangement according to the invention is also suitable for applications in which a fitting arrangement may be devoid of a guide for a sash-side sash guiding element and/or of any sash-side sash guiding element.

A connection between the guiding contour for the sash-side sash guiding element and the bearing leg of the fixed-frame-side support bracket, which connection allows for a mutual adjustment of the guiding contour and of the bearing leg, advantageously allows a fine adjustment of the guide of the sash on the fixed frame.

BRIEF DESCRIPTION OF THE DRAWINGS

The invention will be explained in more detail in the following with reference to exemplary schematic drawings, in which.

DETAILED DESCRIPTION OF PREFERRED EMBODIMENTS

Figure 1A:
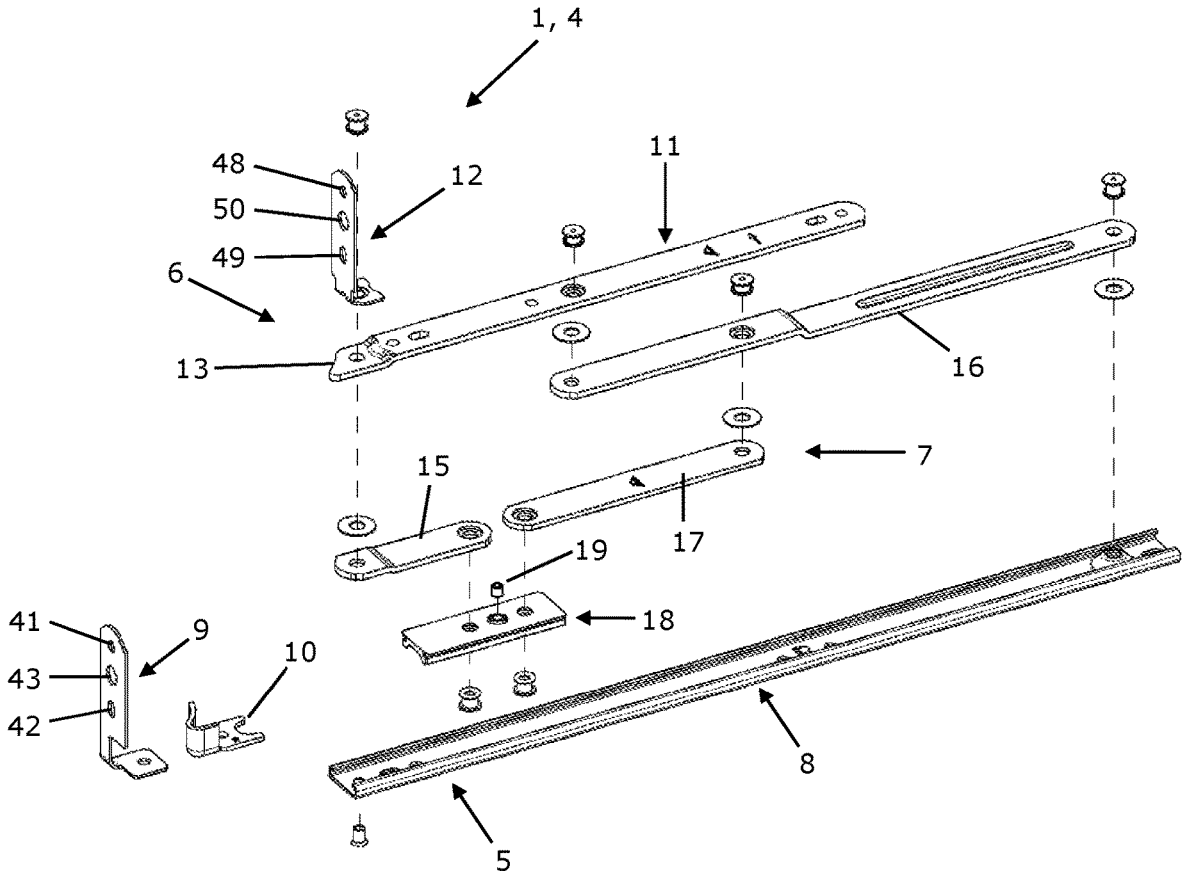
FIG. 1*a* is an exploded view of a fitting unit of a fitting assembly.
Figure 1B:
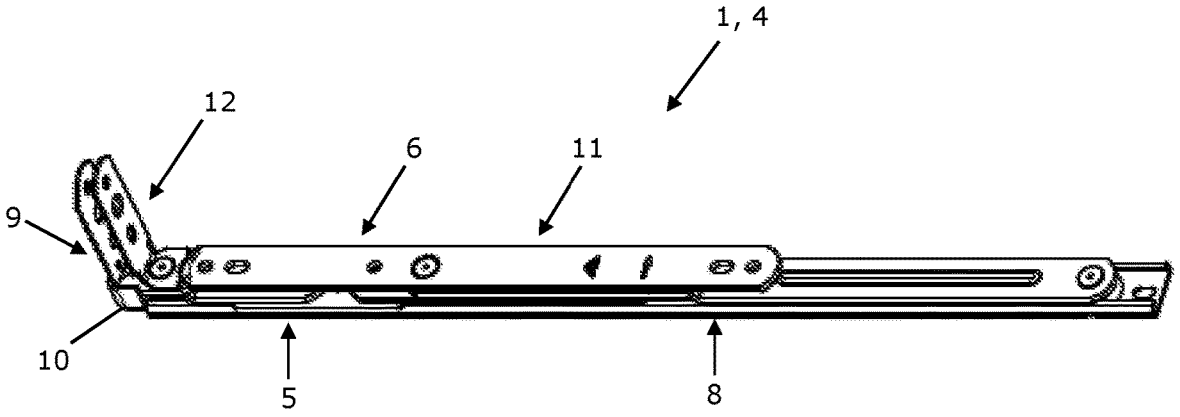
FIG. 1*b* shows the assembled fitting unit of FIG. 1*a* in the closed state.
Figure 1C:
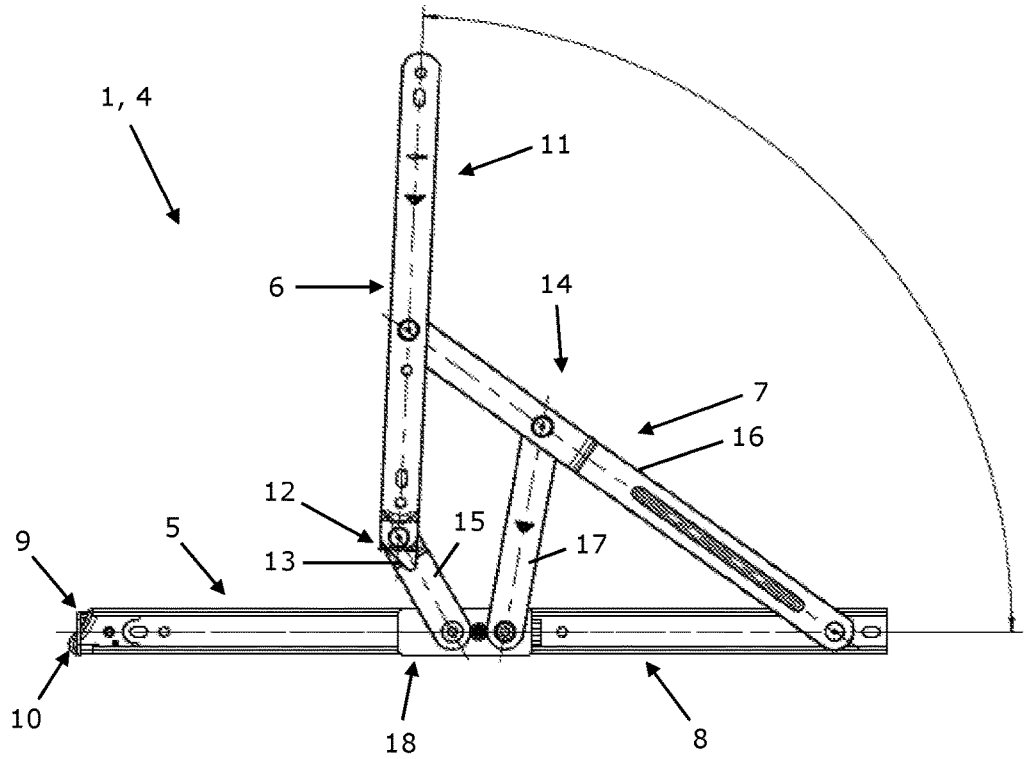
FIG. 1*c* shows the fitting unit of FIG. 1*b* in the open state.
Figure 2A:
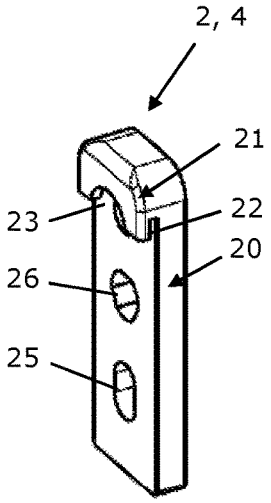
FIGS. 2*a*, 2*b*, 2*c* show a first embodiment of a spacer to be combined with the fitting unit of FIGS. 1*a*, 1*b*, 1*c* in order to form a fitting assembly.
Figure 2B:
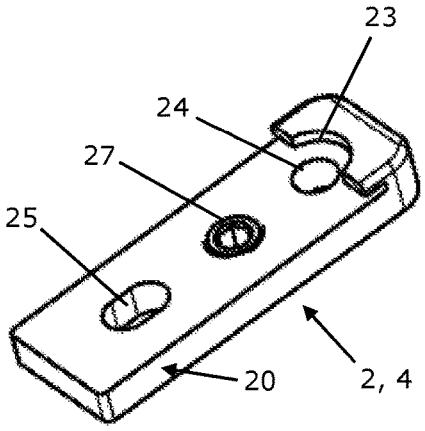
Figure 2C:
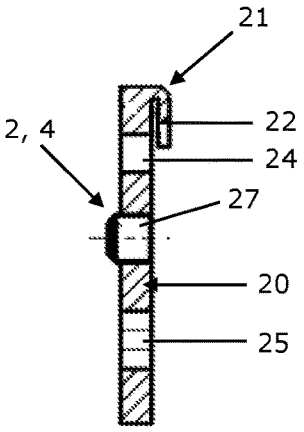
Figure 3A:
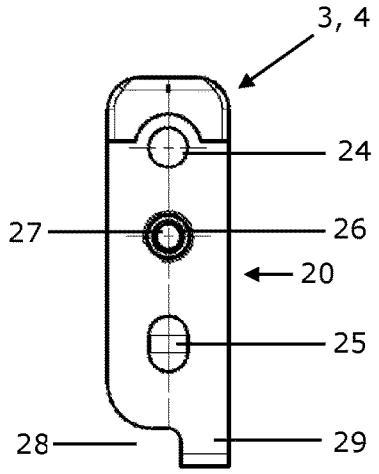
FIGS. 3*a*, 3*b* show a second embodiment of a spacer to be combined with the fitting unit of FIGS. 1*a*, 1*b*, 1*c* in order to form a fitting assembly.
Figure 3B:
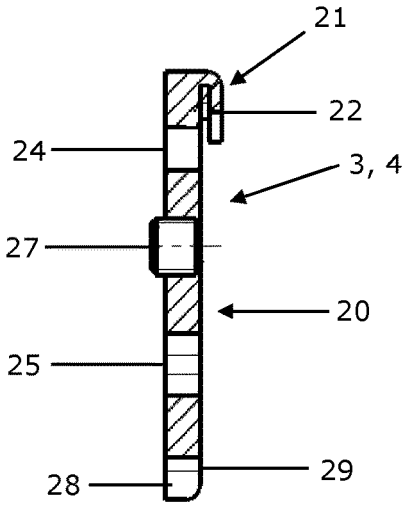

A fitting unit 1 shown in FIGS. 1*a*, 1*b*, 1*c* forms a fitting assembly 4 together with a spacer 2 shown in FIGS. 2*a*, 2*b*, 2*c*, or a spacer 3 shown in FIGS. 3*a*, 3*b*.

The fitting unit 1 comprises a fixed-frame-side support bracket 5, a sash-side support bracket 6 and a scissor-assembly 7 provided between the fixed-frame-side support bracket 5 and the sash-side support bracket 6.

The fixed-frame-side support bracket 5 has a bearing leg 8 and an additional support-bracket leg 9 which is riveted to the bearing leg 8. Moreover, a guiding contour 10 is riveted to the bearing leg 8 of the fixed-frame-side support bracket 5. Instead of the riveted connections provided in the exemplary case shown, for example screwed connections are also conceivable between the individual components of the fixed-frame-side support bracket 5.

The sash-side support bracket 6 is composed of a bearing leg 11 and an additional support-bracket leg 12 riveted thereto. On the side of the bearing leg 11 pointing toward the guiding contour 10 of the fixed-frame-side support bracket 5, the bearing leg 11 of the sash-side support bracket 6 is provided with a sash guiding element in the form of a guiding protrusion 13.

The scissor-assembly 7 comprises Y-scissors 14 and a link 15 as scissor elements. The Y-scissors 14 are formed by scissor elements in the form of a long scissor arm 16 and short scissor arm 17.

The long scissor arm 16 and the short scissor arm 17 of the Y-scissors 14 as well as the link 15 of the scissor assembly 7 are mounted on the bearing leg 8 of the fixed-frame-side support bracket 5 so as to be able to rotate about rotation axes that are perpendicular to the drawing plane in FIG. 1*c*. The rotary bearing of the long scissor arm 16 of the Y-scissors 14 is stationary in the longitudinal direction of the bearing leg 8. In contrast thereto, the rotary bearing points of the short scissor arm 17 of the Y-scissors 14 and of the link 15 provided on the bearing leg 8 of the fixed-frame-side support bracket 5 are provided on a slider 18, which is movably guided along the bearing leg 8 in the longitudinal direction thereof. In this instance, the slider 18 engages, by means of longitudinal edges extending in the movement direction, behind associated longitudinal edges of the bearing leg 8 having a C-shaped cross-section. By actuation of a brake screw 19 rotatably guided on the slider 18, as is known, the motion resistance may be adjusted, which counteracts the movement of the slider 18 along the bearing leg 8.

To the bearing leg 11 of the sash-side support bracket 6, the link 15 and the long scissor arm 16 of the scissor-assembly 7 are rotatably connected by means of stationary rotary bearings. A stationary sash-side rotary bearing of the short scissor arm 17 is arranged on the long scissor arm 16 of the Y-scissors 14 between the rotary bearings at the ends of the long scissor arm 16.

The spacer 2 shown in FIGS. 2*a*, 2*b*, 2*c* has a base body 20 substantially having the shape of a cuboid with a protrusion 21 on the upper end in FIG. 2*a*. The protrusion 21 is provided on the downward-facing side thereof with a receiving channel 22, and a semi-circular cut-out 23. The width of the receiving channel 22 on the spacer 2 is slightly less than the thickness of the additional support-bracket leg 9 of the fixed-frame-side support bracket 5 and the thickness of the additional support-bracket leg 12 of the sash-side support bracket 6. Due to the cut-out 23 on the protrusion 21 of the spacer 2, a cylindrical passage opening 24 provided on the base body 20 of the spacer 2 is accessible in the axial direction of the passage opening 24 for a fixing screw not shown in FIGS. 2*a*, 2*b*, 2*c*. A further passage opening 25 for a fixing screw is provided on the base body 20 of the spacer 2 at a distance from the cylindrical passage opening 24. The passage opening 25, contrary to the passage opening 24, is formed as an oblong hole.

A passage opening 26 is arranged on the base body 20 of spacer 2 between the passage opening 24 and the passage opening 25, which opening 26 is provided with an internal thread, in which an adjustment element in the form of an adjustment screw 27 engages. The adjustment screw 27, designed as a headless screw, is provided at one longitudinal end with an internal hexagon, which is used for engagement of an actuating tool.

The spacer 3 according to FIGS. 3*a*, 3*b* constructively substantially corresponds to the spacer 2 of FIGS. 2*a*, 2*b*, 2*c*. Unlike the spacer 2, the profile of a lower corner on the spacer 3 is rounded and the base body 20 is provided with an extension 29 so as to form a recess 28.

FIGS. 4 to 7*b* show the fitting assembly 4 in the installed state.

Figure 4:
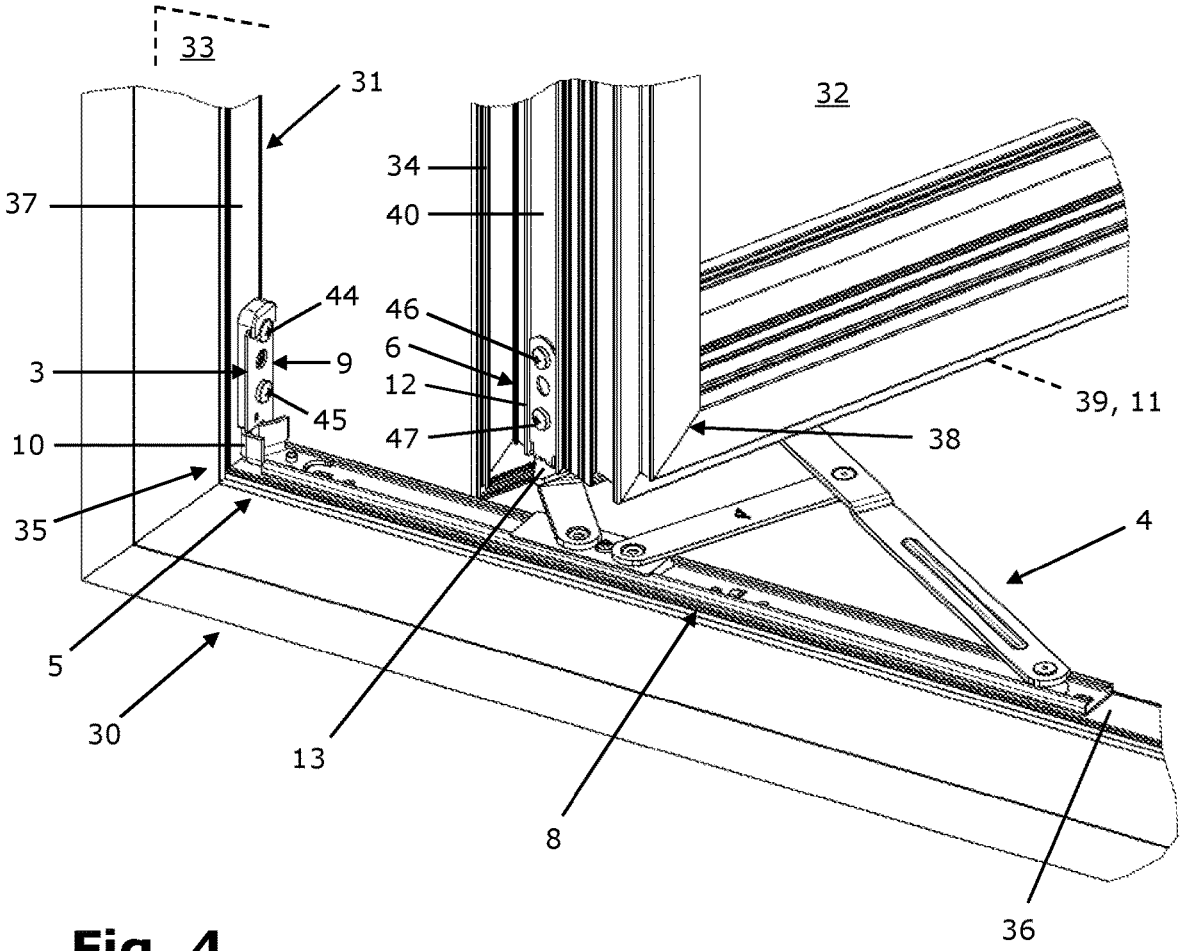
FIG. 4 shows a first embodiment of a window having a fitting assembly according to FIGS. 1*a*, 1*b*, 1*c* and 3*a*, 3*b*, FIGS. 5*a*, 5*b* show a second embodiment of a window having a fitting assembly according to FIGS. 1*a*, 1*b*, 1*c* and 3*a*, 3*b*, FIGS. 6*a*, 6*b* show a third embodiment of a window having a fitting assembly according to FIGS. 1*a*, 1*b*, 1*c* and 3*a*, 3*b*, and FIGS. 7*a*, 7*b* show a fourth embodiment of a window having a fitting assembly according to FIGS. 1*a*, 1*b*, 1*c* and 3*a*, 3*b*.

According to FIG. 4, the fitting assembly 4 is positioned on a window 30 between a fixed frame 31 and a sash 32. The sash 32 opens outwards.

When opening and closing the sash 32, said sash performs a rotational motion about a rotation axis which is vertical in FIG. 4, and also a translational motion, which is perpendicular to a main plane 33 of the fixed frame 31 indicated in FIG. 4. The sash 32 is guided by the fitting assembly 4 in such a way that the sash 32, and in particular a sash overlap 34, does not collide with the fixed frame 31.

In the installed position of the fitting assembly 4, the fixed-frame-side support bracket 5 surrounds a fixed-frame corner 35 which is formed by a horizontal first fixed-frame rebate face 36 in FIG. 4 and a vertical second fixed-frame rebate face 37 in FIG. 4.

The sash-side support bracket 6 surrounds a sash corner 38 of the sash 32, at which corner a horizontal first sash rebate face 39, which is provided in FIG. 4 on the downwardly facing side of sash 32 and is therefore not visible, and a vertical second sash rebate face 40 in FIG. 4 meet.

The first fixed-frame rebate face 36 and the second fixed-frame rebate face 37 as well as the first sash rebate face 39 and the second sash rebate face 40 are formed as groove-free planar rebate faces.

The fixed-frame-side support bracket 5 rests with the bearing leg 8 thereof on the first fixed-frame rebate face 36 and is screwed there to the fixed frame 31. Another screw connection between the fixed-frame-side support bracket 5 and the fixed frame 31 is provided on the additional support-bracket leg 9 of the fixed-frame-side support bracket 5. The additional support-bracket leg 9 of the fixed-frame-side support bracket 5 is supported by means of a spacer, in the illustrated example the spacer 3, on the second fixed-frame rebate face 37 of the fixed frame 31. The spacer 3 is plugged onto the additional support-bracket leg 9. The free end of the additional support-bracket leg 9 engages in the receiving channel 22 provided on the spacer 3. Due to the slight excess of the thickness of the additional support-bracket leg 9 relative to the width of the receiving channel 22, a detachable clamping connection is produced between the spacer 3 and the additional support-bracket leg 9. In addition, the receiving channel 22 forms a positioning element and in this respect provides for a defined arrangement of the spacer 3 on the additional support-bracket leg 9 of the fixed-frame-side support bracket 5.

When the spacer 3 is mounted on the additional support-bracket leg 9, the passage openings 41, 42 and a further opening 43, which are all provided on the additional support-bracket leg 9 of the fixed-frame-side support bracket 5, are aligned with the passage openings 24, 25, 26 on the spacer 3. In order to secure the additional support-bracket leg 9 to the second fixed-frame rebate face 37, fastening screws 44, 45 are used as fastening elements and screwed into the fixed frame 31 through the paired aligned passage openings 41, 24; 42, 25 on the additional support-bracket leg 9 and on the spacer 3. The opening 43 on the additional support-bracket leg 9 allows access to the adjusting screw 27, which is received on the spacer 3 in the passage opening 26 thereof. By means of the adjusting screw 27, the fixed-frame-side support bracket 5, before being screwed to the fixed frame 31, is finely adjusted with respect to the fixed frame 31 perpendicularly to the second fixed-frame rebate face 37 and the additional support-bracket leg 9 extending in parallel therewith.

The thickness of the spacer 3 between the side of the additional support-bracket leg 9 of the fixed-frame-side support bracket 5 facing the second fixed-frame rebate face 37 on the one hand and the second fixed-frame rebate face 37 on the other hand corresponds to the extent of the projection, by which the guiding contour 10 protrudes, on the side of the additional support-bracket leg 9 facing the second fixed-frame rebate face 37, with respect to said additional support-bracket leg towards the second fixed-frame rebate face 37. As a result, the spacer 3 on the additional support-bracket leg 9 can ensure planar support of the fixed-frame-side support bracket 5 on the fixed frame 31. The projection of the guiding contour 10 is located on the spacer 3 within the recess 28 delimited on one side by the extension 29.

The sash-side support bracket 6 is screwed to the sash 32 through the bearing leg 11, which is covered in FIG. 4, on the first sash rebate face 39, also not visible in FIG. 4, and through the additional support-bracket leg 12 on the second sash rebate face 40. The bearing leg 11 rests directly on the first sash rebate face 39, the additional support-bracket leg 12 rests directly on the second sash rebate face 40. Fastening elements in the form of fastening screws 46, 47 pass through passage openings 48, 49 on the additional support-bracket leg 12. An opening 50 on the additional support-bracket leg 12 is not used in the installation conditions according to FIG. 4. The guiding projection 13 on the bearing leg 11 of the sash-side support bracket 6 protrudes on the side of the additional support-bracket leg 12 facing the fixed-frame-side guiding contour 10 and interacts during the final phase of the closing movement of sash 32 with the guiding contour 10 such that the sash 32 can reach the closed position thereof against the fixed frame 31 in a collision-free manner.

Figure 5A:
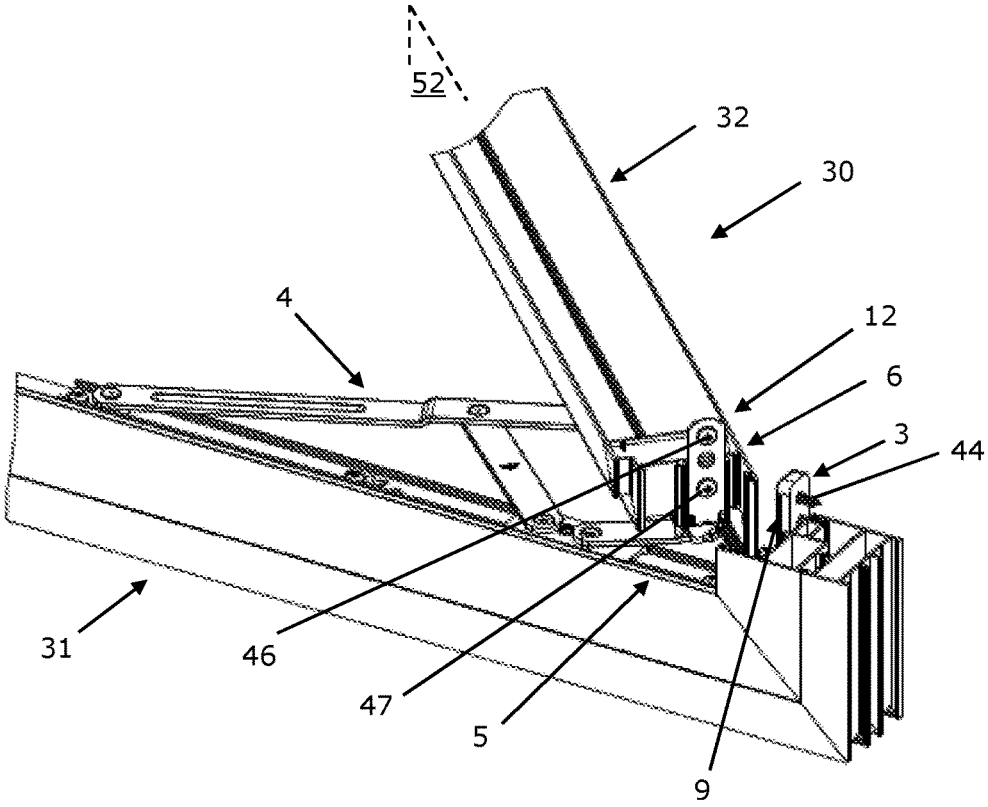
Figure 5B:
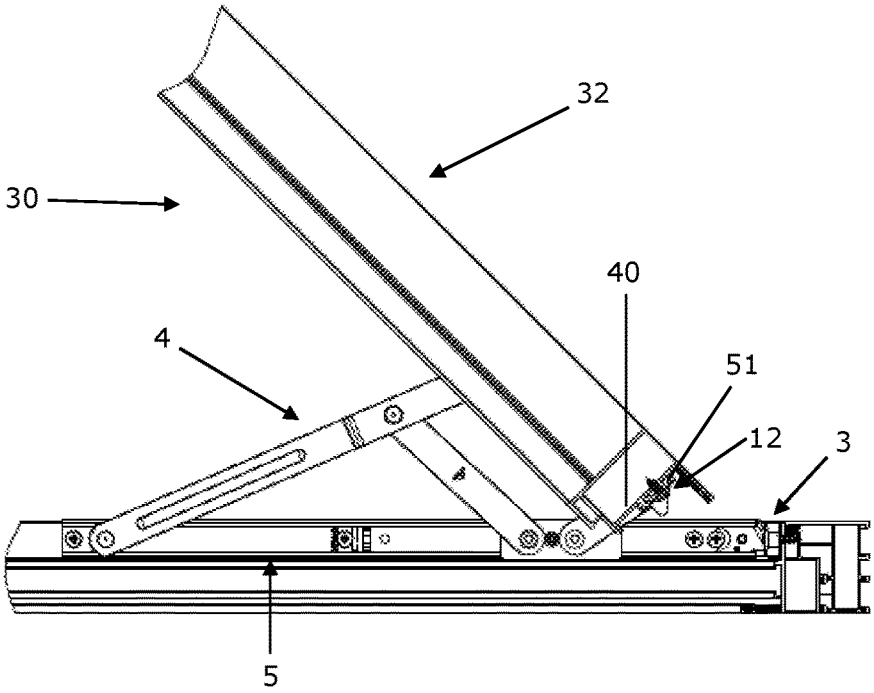
Figure 6A:
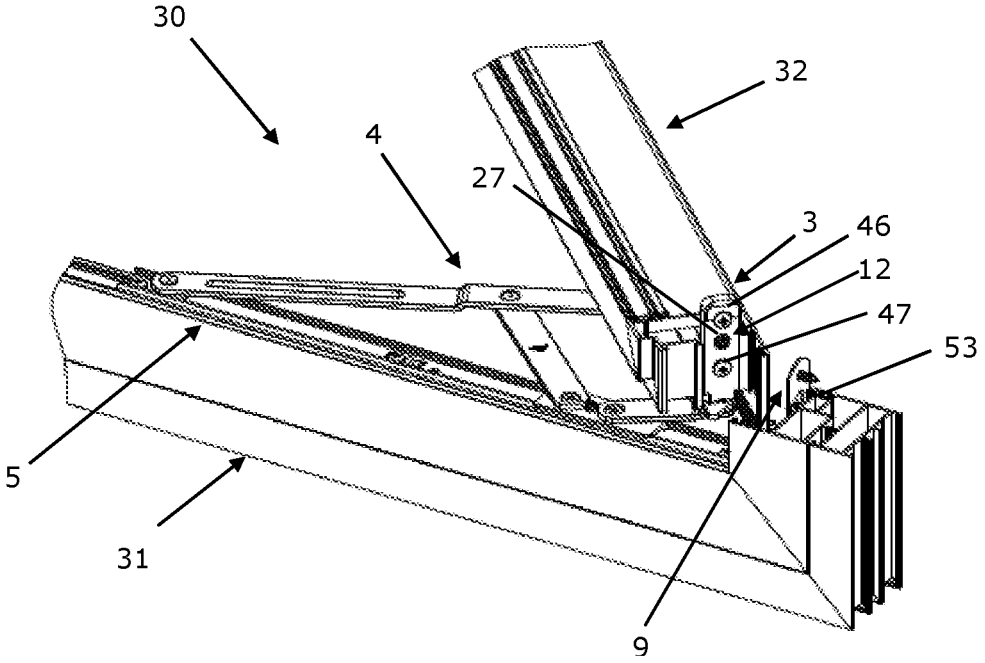
Figure 6B:
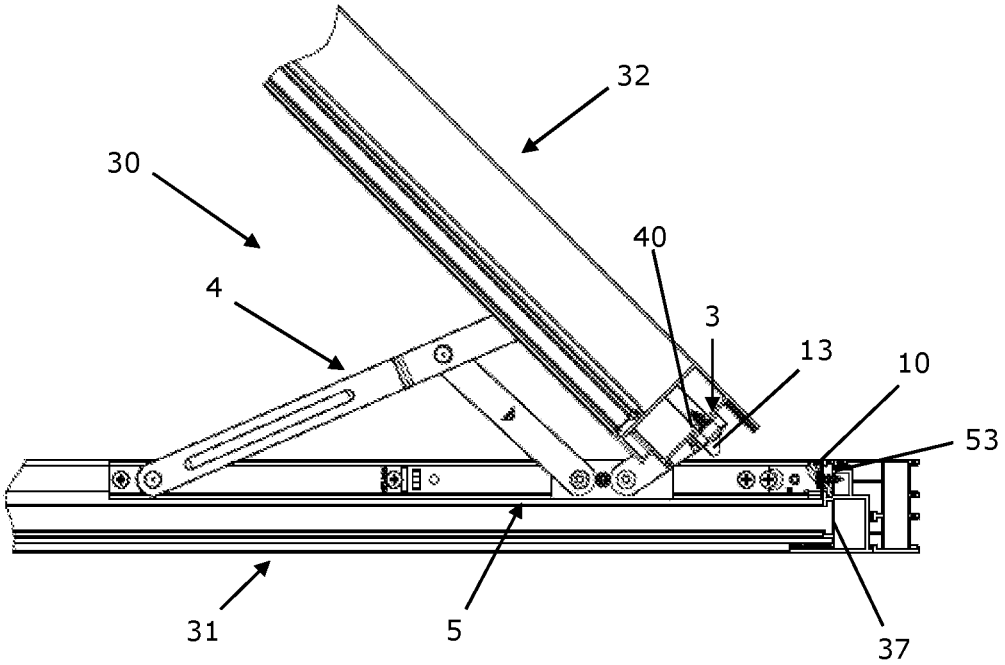
Figure 7A:
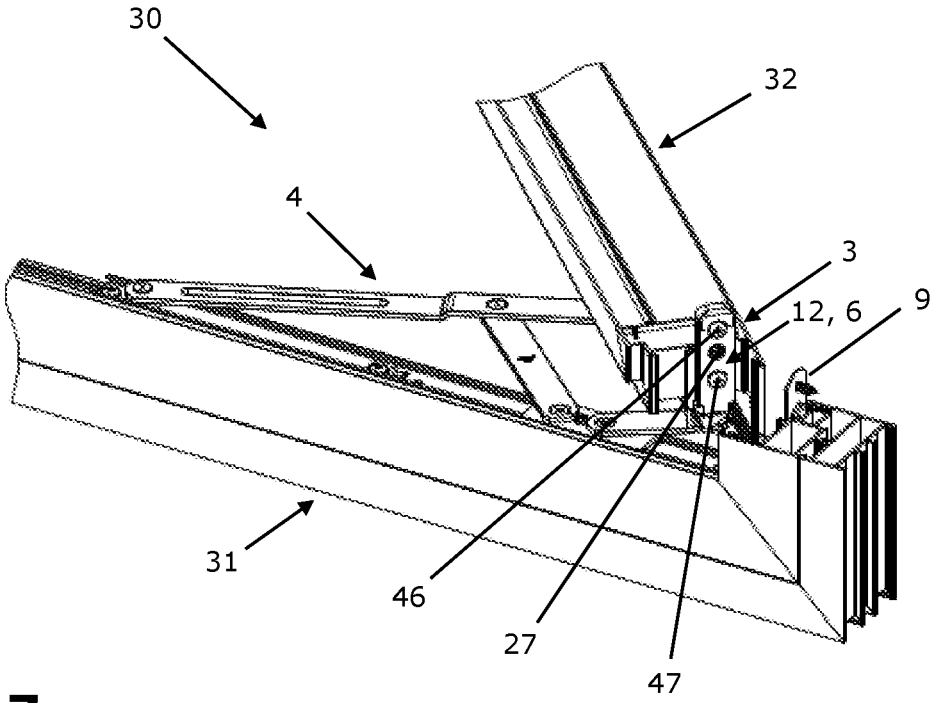
Figure 7B:
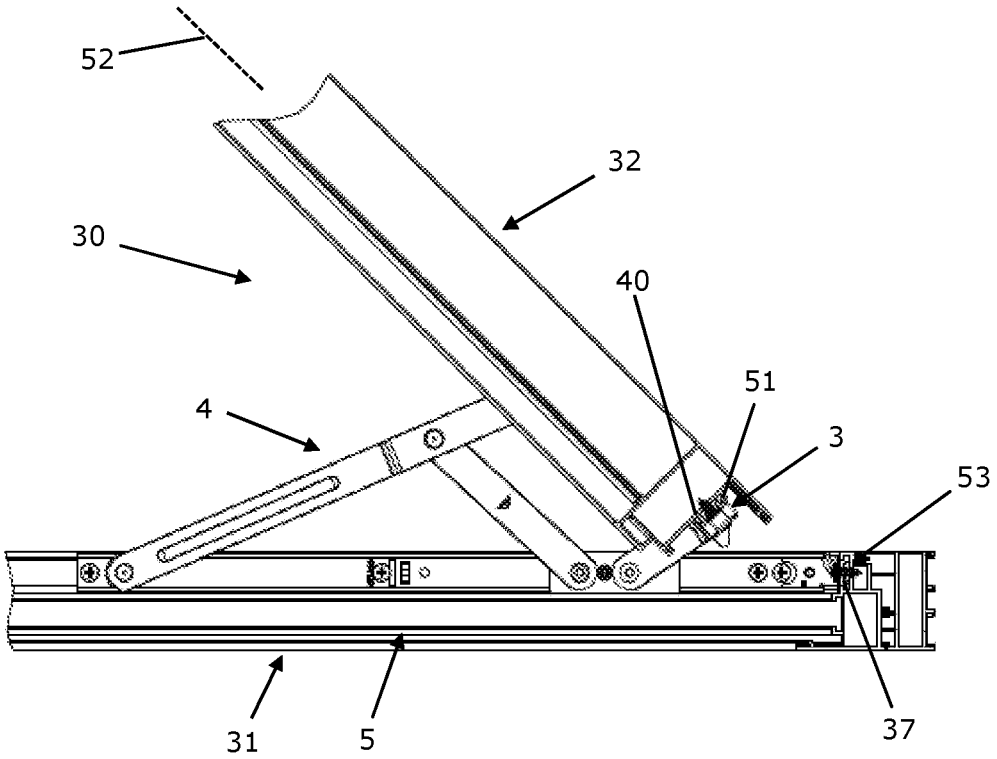

The installation conditions shown in FIGS. 5*a*, 5*b* on the window 30 substantially correspond to those of FIG. 4. Unlike FIG. 4, in FIGS. 5*a*, 5*b*, a fitting groove 51 extending in the peripheral direction of the sash 32 is provided only on the second sash rebate face 40. The additional support-bracket leg 12 of the sash-side support bracket 6 has a width perpendicular to a main plane 52 of the sash 32 in FIG. 5*a*, which is larger than the opening width of the fitting groove 51. Thus the additional support-bracket leg 12 of the sash-side support bracket 6 is able to be mounted on the second sash rebate face 40 so as to cover the fitting groove 51 resting on the outside thereof. To this end, the fastening screws 46, 47 are screwed through the passage openings 48, 49 on the additional support-bracket leg 12 of the sash-side support bracket 6 into the groove base of the sash-side fitting groove 51.

Unlike FIGS. 4 and 5*a*, 5*b*, FIGS. 6*a*, 6*b* and 7*a*, 7*b* show a window 30 having a fixed frame 31, the second fixed-frame rebate face 37 of which is provided with a fitting groove 53 extending in the circumferential direction of the fixed frame 31. The second sash rebate face 40 of the sash 32 is configured in FIGS. 6*a*, 6*b* as a groove-free planar surface and in FIGS. 7*a*, 7*b* it is provided with a fitting groove 51.

The fitting groove 53 on the second fixed-frame rebate face 37 receives the projection of the guiding contour 10 on the fixed-frame-side support bracket 5. As a result, the additional support-bracket leg 9 of the fixed-frame-side support bracket 5 may rest flat directly on the second fixed-frame rebate face 37.

On the sash side, the spacer 3 in FIGS. 6*a*, 6*b* and 7*a*, 7*b* is arranged on the side of the additional support-bracket leg 12 of the sash-side support bracket 6 facing the second sash rebate face 40. The additional support-bracket leg 12 of the sash-side support bracket 6 screwed to the sash 32 is supported in a planar manner on the second sash rebate face 40 by means of the spacer 3, it being possible to mount the spacer 3 in FIGS. 7*a*, 7*b* on the sash-side fitting groove 51 so as to rest on the outside, since the width of the spacer 3 perpendicular to the main plane 52 of the sash 32 is larger than the opening width of the fitting groove 51 on the second fixed-frame rebate face 40.

The width of the rebate clearance, i.e. the width of the gap formed between the second fixed-frame rebate face 37 and the second sash rebate face 40, when the sash 32 is closed, is the same in all installation conditions shown in FIGS. 4 to 7*b*.

What is claimed is:

1. A fitting assembly to be positioned between a fixed frame and a sash of a window or a door, the fitting assembly being configured such that the sash is movable by means of the fitting assembly relative to the fixed frame by performing a rotational and a translational movement, the fitting assembly comprising:

a fixed-frame-side support bracket configured to be positioned on a fixed-frame corner formed by first and second fixed-frame rebate faces of the fixed frame, the fixed-frame-side support bracket having two support-bracket legs, of which a first support-bracket leg is configured to be fixed to the first fixed-frame rebate face and forms a bearing leg of the fixed-frame-side support bracket and of which a second support-bracket leg is configured to be fixed to the second fixed-frame rebate face and is provided as an additional support-bracket leg of the fixed-frame-side support bracket, a sash-side support bracket configured to be positioned on a sash corner formed by first and second sash rebate faces of the sash, the sash-side support bracket having two support-bracket legs, wherein one of said support-bracket legs forms a sash-side support element in the form of a bearing leg of the sash-side support bracket and is configured to be fixed to the first sash rebate face, and wherein an additional one of the support-bracket legs of the sash-side support bracket is configured to be fixed to the second sash rebate face, wherein, in a closed state of the fitting assembly when the sash is closed with respect to the fixed frame, the sash corner and the fixed-frame corner are opposite each other and the bearing leg of the sash-side support bracket is opposite the bearing leg of the fixed-frame-side support bracket, a sash-side guiding element that protrudes from a side of the additional support-bracket leg of the sash-side support bracket that is remote from the second sash rebate face in an installed state of the fitting assembly, a guiding contour for the sash-side sash guiding element being provided on the fixed-frame-side support bracket, the guiding contour being formed as a projection that protrudes from a side of the additional support-bracket leg of the fixed-frame-side support bracket that faces the second fixed-frame rebate face in the installed state of the fitting assembly, a scissor assembly supported on the bearing leg of the fixed-frame-side support bracket and on the bearing leg of the sash-side support bracket and being configured such that the bearing leg of the sash-side support bracket is movable relative to the bearing leg of the fixed-frame-side support bracket by performing a rotational and a translational movement, and a spacer configured to be positioned on a side of the additional support-bracket leg of the fixed-frame-side support bracket facing the second fixed-frame rebate face or on the side of the additional support-bracket leg of the sash-side support bracket facing the second sash rebate face, the spacer having a thickness which is at least equal to an extension of the projection of the guiding contour which extension is provided between the side of the additional support-bracket leg of the fixed-frame-side support bracket facing the second fixed-frame rebate face, and the second fixed-frame rebate face.

2. The fitting assembly according to claim 1, wherein the spacer is removably connected to the additional support-bracket leg of the fixed-frame-side support bracket or to the additional support-bracket leg of the sash-side support bracket, by a removable clamping or a removable locking connection.

3. The fitting assembly according to claim 1, further comprising a positioning element being disposed on the additional support-bracket leg of the fixed-frame-side support bracket and/or on the additional support-bracket leg of the sash-side support bracket and/or on the spacer, the positioning element being configured for positioning the spacer on the side of the additional support-bracket leg of the fixed-frame-side support bracket facing the second fixed-frame rebate face with a defined arrangement with respect to the additional support-bracket leg of the fixed-frame-side support bracket, or on the side of the additional support-bracket leg of the sash-side support bracket facing the second sash rebate face with a defined arrangement with respect to the additional support-bracket leg of the sash-side support bracket.

4. The fitting assembly according to claim 1, wherein the additional support-bracket leg of the fixed-frame-side support bracket is configured to be fixed to the second fixed-frame rebate face, and is provided with a passage opening for a fastening element, and wherein the spacer is provided with a passage opening for a fastening element, such that when the spacer is positioned on the side of the additional support-bracket leg of the fixed-frame-side support bracket facing the second fixed-frame rebate face, the passage opening provided on the spacer aligns with the passage opening provided on said additional support-bracket leg.

5. The fitting assembly according to claim 1, wherein the additional support-bracket leg of the fixed-frame-side support bracket is provided with an opening for an adjustment element for adjusting the position of the fixed-frame-side support bracket perpendicularly to the additional support-bracket leg of the fixed-frame-side support bracket with respect to the fixed frame, wherein the spacer is provided with a passage opening for an adjustment element, and wherein when the spacer is positioned on the side of the additional support-bracket leg of the fixed-frame-side support bracket facing the second fixed-frame rebate face, the passage opening provided on the spacer aligns with the opening for an adjustment element provided on said additional support-bracket leg.

6. The fitting assembly according to claim 1, wherein the guiding contour for the sash-side sash guiding element is connected to the bearing leg of the fixed-frame-side support bracket.

7. The fitting assembly according to claim 6, wherein the guiding contour is adjustable with respect to the fixed-frame-side support bracket.

8. A window or door comprising:

a fixed frame having a fixed-frame corner formed by a first fixed-frame rebate face and a second fixed-frame rebate face of the fixed frame, a sash having a sash corner being formed by a first sash rebate face and a second sash rebate face of the sash wherein, when the sash is closed with respect to the fixed frame, the sash corner and the fixed-frame corner are opposite each other, and a fitting assembly according to claim 1, said fitting assembly being positioned between the fixed frame and the sash such that the sash is movable by means of the fitting assembly relative to the fixed frame by performing a rotational and translational movement of the sash, wherein the second fixed-frame rebate face is a groove-free planar rebate face, wherein the spacer is positioned on the side of the additional support-bracket leg of the fixed-frame-side support bracket facing the second fixed-frame rebate face, and wherein the spacer has a thickness which is at least equal to an extension of the projection of the guiding contour for the sash-side sash guiding element which extension is provided between the side of the additional support-bracket leg of the fixed-frame-side support bracket facing the second fixed-frame rebate face and the second fixed-frame rebate face.

9. The window or door according to claim 8, wherein the second sash rebate face is a groove-free planar rebate face.

10. The window or door according to claim 8, wherein the second sash rebate face is provided with a fitting groove extending in a peripheral direction of the sash and comprising a groove opening which has an opening width, perpendicular to a main plane of the sash, and wherein the additional support-bracket leg of the sash-side support bracket has a width perpendicular to the main plane of the sash that is larger than the opening width of the fitting groove on the second sash rebate face, and wherein the additional support-bracket leg of the sash-side support bracket covers the fitting groove on the second sash rebate face so as to rest on an outside.

11. A window or door comprising:

a fixed frame having a fixed-frame corner being formed by a first fixed-frame rebate face and a second fixed-frame rebate face;

a sash having a sash corner being formed by a first sash rebate face and a second sash rebate face such that when the sash is closed with respect to the fixed frame, the sash corner and the fixed-frame corner are opposite each other, and a fitting assembly according to claim 1, the fitting assembly being positioned between the fixed frame and the sash and configured such that the sash is movable by means of the fitting assembly by performing a rotational and translational movement, wherein the second fixed-frame rebate face is provided with a fitting groove extending in a peripheral direction of the fixed frame and comprising a groove opening, said groove opening having an opening width perpendicular to a main plane of the fixed frame, wherein the additional support-bracket leg of the fixed-frame-side support bracket perpendicular to the main plane of the fixed frame has a width which is larger than the opening width of the fitting groove on the second fixed-frame rebate face and the additional support-bracket leg of the fixed-frame-side support bracket covers the fitting groove on the second fixed-frame rebate face so as to rest on an outside, wherein the guiding contour for the sash-side sash guiding element is receivable in the fitting groove on the second fixed-frame rebate face with the projection on a side of the additional support-bracket leg of the fixed-frame-side support bracket facing the second fixed-frame rebate face, and wherein the spacer of the fitting assembly is positioned on a side of the additional support-bracket leg of the sash-side support bracket facing the second sash rebate face.

12. The window or door according to claim 11, wherein the second sash rebate face is a groove-free planar rebate face.

13. The window or door according to claim 11, wherein the second sash rebate face is provided with a fitting groove extending in a peripheral direction of the sash and comprising a groove opening which has an opening width perpendicular to a main plane of the sash, and wherein the spacer has a width perpendicular to the main plane of the sash that is larger than the opening width of the fitting groove on the second sash rebate face and wherein the additional support-bracket leg of the sash-side support bracket covers the fitting groove on the second sash rebate face so as to rest on an outside.

14. The fitting assembly according to claim 1, wherein the additional support-bracket leg of the sash-side support bracket is configured to be fixed to the second sash rebate face, and is provided with a passage opening for a fastening element, and wherein the spacer is provided with a passage opening for a fastening element, such that when the spacer is positioned on the side of the additional support-bracket leg of the sash-side support bracket facing the second sash rebate face, the passage opening provided on the spacer aligns with the passage opening provided on said additional support-bracket leg.

15. The fitting assembly according to claim 1, wherein the additional support-bracket leg of the sash-side support bracket is provided with an opening for an adjustment element for adjusting the position of the sash-side support bracket perpendicularly to the additional support-bracket leg of the sash-side support bracket with respect to the sash, wherein the spacer is provided with a passage opening for an adjustment element, and wherein when the spacer is positioned on the side of the additional support-bracket leg of the sash-side support bracket facing the second sash rebate face, the passage opening provided on the spacer aligns with the opening for an adjustment element provided on said additional support-bracket leg.

* * * * *